US009445459B2

(12) United States Patent
Verreault et al.

(10) Patent No.: US 9,445,459 B2
(45) Date of Patent: Sep. 13, 2016

(54) SLOTTED SHOT SLEEVE FOR INDUCTION MELTING OF MATERIAL

(71) Applicant: CRUCIBLE INTELLECTUAL PROPERTY, LLC, Rancho Santa Margarita, CA (US)

(72) Inventors: Adam A Verreault, Dove Canyon, CA (US); Sean T. O'Keeffe, Rancho Santa Margarita, CA (US); Joseph W Stevick, Rancho Santa Margarita, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 13/940,051

(22) Filed: Jul. 11, 2013

(65) Prior Publication Data

US 2015/0013933 A1 Jan. 15, 2015

(51) Int. Cl.

| | |
|---|---|
| ***B22D 17/10*** | (2006.01) |
| ***H05B 6/24*** | (2006.01) |
| ***B22D 17/04*** | (2006.01) |
| ***B22D 17/00*** | (2006.01) |
| ***B22D 17/20*** | (2006.01) |

(52) U.S. Cl.

CPC ..... *H05B 6/24* (2013.01); *B22D 17/007* (2013.01); *B22D 17/04* (2013.01); *B22D 17/10* (2013.01); *B22D 17/2023* (2013.01); *B22D 17/2038* (2013.01)

(58) Field of Classification Search

CPC ..... B22D 41/01; B22D 17/2023; B22D 17/2038; F27B 14/063; H05B 6/24

USPC ..... 164/303, 312, 493, 507, 513, 113; 266/234, 241, 242

See application file for complete search history.

(56) References Cited

U.S. PATENT DOCUMENTS

| | | | |
|---|---|---|---|
| 3,671,029 | A | 6/1972 | Kurlsson |
| 3,731,727 | A | 5/1973 | Mitamura et al. |

(Continued)

FOREIGN PATENT DOCUMENTS

| | | |
|---|---|---|
| CA | 2010961 | 3/1997 |
| DE | 19902002 | 7/2000 |

(Continued)

OTHER PUBLICATIONS

JPO machine translation of JP 2007083286 A, Apr. 5, 2007.*

(Continued)

*Primary Examiner* — Kevin E Yoon

(74) *Attorney, Agent, or Firm* — Brownstein Hyatt Farber Shreck

(57) ABSTRACT

Disclosed are embodiments of a vessel configured to contain a secondary magnetic induction field therein for melting materials, and methods of use thereof. The vessel can be used in an injection molding apparatus having an induction coil positioned along a horizontal axis and adjacent to the vessel. The vessel can have a tubular body configured to substantially surround and receive a plunger tip. At least one longitudinal slot extends through the thickness of the body to allow and/or direct eddy currents into the vessel during application of an RF induction field from the coil. The body also includes temperature regulating lines configured to flow a liquid within. The temperature regulating lines can be provided to run longitudinally within the wall(s) of the body between its inner bore and outer surface(s). A flange may be provided at one end of the body to secure the body within an injection molding apparatus.

26 Claims, 6 Drawing Sheets

(56) References Cited

U.S. PATENT DOCUMENTS

| | | | | |
|---|---|---|---|---|
| 4,040,845 | A | 8/1977 | Richerson et al. | |
| 4,049,384 | A * | 9/1977 | Wenckus et al. | 117/203 |
| 4,135,568 | A | 1/1979 | Brooks | |
| 4,265,294 | A | 5/1981 | Gaule | |
| 4,550,412 | A | 10/1985 | Holcombe et al. | |
| 4,612,973 | A | 9/1986 | Whang | |
| 4,678,024 | A | 7/1987 | Hull | |
| 4,693,299 | A | 9/1987 | Kuznetsov et al. | |
| 4,738,713 | A | 4/1988 | Stickle | |
| 4,799,532 | A | 1/1989 | Mizuhara | |
| 4,887,798 | A | 12/1989 | Julius | |
| 5,003,551 | A | 3/1991 | Mortimer | |
| 5,055,025 | A | 10/1991 | Muller | |
| 5,087,804 | A | 2/1992 | McGaffigne | |
| 5,288,344 | A | 2/1994 | Peker et al. | |
| 5,368,659 | A | 11/1994 | Peker et al. | |
| 5,487,421 | A | 1/1996 | Gerber | |
| 5,616,024 | A | 4/1997 | Nobori | |
| 5,618,359 | A | 4/1997 | Lin et al. | |
| 5,711,363 | A | 1/1998 | Scruggs et al. | |
| 5,735,975 | A | 4/1998 | Lin et al. | |
| 5,896,642 | A | 4/1999 | Peker | |
| 5,976,247 | A | 11/1999 | Hansen et al. | |
| 6,021,840 | A | 2/2000 | Colvin | |
| 6,189,600 | B1 | 2/2001 | Taniguchi et al. | |
| 6,210,478 | B1 * | 4/2001 | Bewlay | C30B 13/00 117/37 |
| 6,267,170 | B1 | 7/2001 | Onuki | |
| 6,267,171 | B1 | 7/2001 | Onuki | |
| 6,283,197 | B1 | 9/2001 | Kono | |
| 6,325,868 | B1 | 12/2001 | Kim et al. | |
| 6,371,195 | B1 | 4/2002 | Onuki | |
| 6,427,753 | B1 | 8/2002 | Inoue | |
| 6,875,293 | B2 | 4/2005 | Peker | |
| 7,017,645 | B2 | 3/2006 | Johnson et al. | |
| 7,235,910 | B2 | 6/2007 | Decristofaro et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu | |
| 7,906,219 | B2 | 3/2011 | Ohara | |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0042773 | A1 | 3/2006 | Eisen | |
| 2006/0254747 | A1 | 11/2006 | Ishida et al. | |
| 2006/0291529 | A1 * | 12/2006 | Haun et al. | 373/156 |
| 2007/0079907 | A1 | 4/2007 | Johnson et al. | |
| 2008/0118387 | A1 | 5/2008 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0098967 | A1 | 4/2010 | Schroers | |
| 2010/0300148 | A1 | 12/2010 | Demetriou et al. | |
| 2011/0011750 | A1 | 1/2011 | Lovens | |
| 2011/0108231 | A1 | 5/2011 | Zheng et al. | |

FOREIGN PATENT DOCUMENTS

| | | | |
|---|---|---|---|
| EP | 0845316 | | 6/1998 |
| EP | 1013363 | | 6/2000 |
| EP | 1415740 | | 5/2004 |
| FR | 2665654 | | 2/1992 |
| GB | 392764 | | 5/1933 |
| GB | 574914 | | 1/1946 |
| GB | 784363 | | 10/1957 |
| JP | 55036033 | | 3/1980 |
| JP | 6212205 | | 8/1994 |
| JP | 8013111 | | 1/1996 |
| JP | 9272929 | | 10/1997 |
| JP | 10208860 | A * | 8/1998 |
| JP | 2000024767 | | 1/2000 |
| JP | 2000292071 | A * | 10/2000 |
| JP | 2000326065 | | 11/2000 |
| JP | 2001071113 | | 3/2001 |
| JP | 2001259821 | | 9/2001 |
| JP | 2001303218 | | 10/2001 |
| JP | 2002029727 | | 1/2002 |
| JP | 2004050269 | | 2/2004 |
| JP | 2006289466 | | 10/2006 |
| JP | 2007083286 | A * | 4/2007 |
| JP | 2009068101 | | 4/2009 |
| JP | 2009172627 | | 8/2009 |
| JP | 2009173964 | | 8/2009 |
| JP | 2010036210 | | 2/2010 |
| WO | WO0037201 | | 6/2000 |
| WO | WO0240727 | | 5/2002 |
| WO | WO2005004559 | | 1/2005 |
| WO | WO2006127792 | | 11/2006 |
| WO | WO2008046219 | | 4/2008 |
| WO | WO2009067512 | | 5/2009 |
| WO | WO2010108744 | | 9/2010 |
| WO | WO2010111701 | | 9/2010 |

OTHER PUBLICATIONS

Inoue et al., "Bulk amorphous alloys with high mechanical strength and good soft magnetic properties in Fe-Tm-B(TM=IV-VIII group transition metal) system", Appl. Phys. Lett., vol. 710, p. 464 (1997).

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

International Search Report issued in PCT/US2011/052354, mailed Mar. 16, 2012.

International Search Report issued in PCT/US2011/054153, mailed Jun. 13, 2012.

International Search Report issued in PCT/US2012/022227, mailed Jan. 15, 2013.

Wolf, S.; R.N. Tauber (1986),Silicon Processing for the VLSI Era: vol. 1—Process Technology. Lattice Press. pp. 531-534, 546.

Walker, Perrin; William H. Tarn (1991), CRC Handbook of Metal Etchants. pp. 287-291.

Kohler, Michael (1999). Etching in Microsystem Technology. John Wiley & Son Ltd. p. 329.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.

* cited by examiner

SLOTTED SHOT SLEEVE FOR INDUCTION MELTING OF MATERIAL

FIELD

The present disclosure is generally related to vessels used for melting materials. More specifically, it relates to a slotted shot sleeve or vessel configured to utilize a magnetic field from an induction source to melt material.

BACKGROUND

Some injection molding machines use an induction coil to melt material in a boat before injecting the material into a mold. In horizontally disposed injecting molding machines, material can be melted in a boat that is positioned for horizontal injection. Some machines have utilized a boat that is substantially U-shaped; that is, a boat that includes body with a base and side walls extending partially upwardly therefrom but that end around a midpoint or equator. This configuration results in a low-walled vessel design that resembles a partial portion (e.g., lower half) of a tube (as opposed to a fully enclosed, round tube) with an open top portion designed for exposure to a magnetic field from the induction coil in order to melt material therein. This low-walled boat design can reduce both boat and plunger tip life. Also, the U-shaped design is subject to molten metal to flow over its sides during melting or during plunging of the metal. Further, because the plunger tip is minimally captured on top, it has some play in the direction perpendicular to the bore, which can result in it digging into a lip of the walls or cutout region, causing wear. Poor control of a plunger-tip to boat wall gap can allow penetration of flash into a gap that is too large on the bottom or sides of the tip during injection. Also, metal flash can build up at an edge of the cutout region in such a U-shaped boat. The boat may be unstable and have a greater tendency to flex. Moreover, heating in a U-shaped boat utilizes primary and secondary fields from an induction coil; such boat designs can suffer from excessive heating at its top edges, causing the boat to expand and curve if cooling is insufficient.

In some skull melting machines, a vertically positioned concentrator-type cage melter, surrounded by an induction coil, can be used to melt materials. Skull melters may have a vertically enclosed tubular configuration, for example, or may have a number of segments or fingers positioned in a substantially circular or tubular configuration, having multiple slots or openings therebetween, connected to a solid bottom, for example.

When melting materials in an injection molding system, uniform temperatures in ranges appropriate to the meltable material should be implemented and maintained in order to produce quality molded parts. Utilizing effective vessels during melting can improve such quality.

SUMMARY

A proposed solution according to embodiments herein for melting materials (e.g., metals or metal alloys) in a vessel that is configured to allow, receive, aid in receipt, utilize, and/or direct a magnetic field (e.g., from an induction coil) via at least one slot to melt materials.

In accordance with various embodiments, there is provided a temperature regulated vessel. The vessel can include: a substantially tubular body with a first end and a second end along a longitudinal direction; a longitudinal slot extending between the first end and the second end of the substantially tubular body in the longitudinal direction and through a complete thickness of the substantially tubular body; and one or more temperature regulating channels configured to flow a liquid within the substantially tubular body. The vessel is configured for use with a horizontally positioned induction coil configured to melt a meltable material in the vessel. The longitudinal slot is configured to receive eddy currents within the vessel during application of an induction field by the induction coil. The substantially tubular body is configured to substantially contain a second magnetic field produced by the eddy currents from the induction field to melt the meltable material during its application. Also, the one or more temperature regulating channels are configured to regulate a temperature of the vessel during the application of the induction field.

In accordance with various embodiments, there is provided an apparatus. The apparatus can include: a vessel having an inner bore configured to receive a meltable material for melting therein; an induction coil configured to melt the meltable material in the vessel positioned adjacent thereto; and a plunger rod with a tip configured to move relative to the vessel. The vessel has a longitudinal slot extending through a complete thickness of the vessel. The longitudinal slot is configured to direct eddy currents into the inner bore during application of an induction field by the induction coil to aid in melting the meltable material during its application. The tip of the plunger rod is configured to move into the inner bore of the vessel to contain the meltable material within the vessel during the application of the induction field.

In accordance with various embodiments, there is provided a method. The method includes: providing meltable material in a vessel; operating a heat source provided adjacent to the vessel to form a molten material, and regulating a temperature of the vessel during the operating of the heat source. The vessel has a body and a slot extending through a complete thickness of the body. The body is configured to utilize a magnetic field from the heat source to the meltable material within the vessel during the operating via allowance of eddy currents into the body of the vessel through the slot. The vessel also includes one or more temperature regulating channels therein, and the regulating of the method includes flowing a fluid in the one or more temperature regulating channels.

In accordance with various embodiments, there is provided a vessel. The vessel can include: a body having an inner bore configured to receive a meltable material for melting therein and an outer surface. The inner bore can be formed by an inner surface that extends between a first end and a second end of the body. The vessel also includes at least one slot extending between the first end and the second end of the body and through the body from the outer surface to part of the surface forming the inner bore, and one or more temperature regulating channels provided within the body between the inner surface of the bore and the outer surface and extending between the first end and the second end of the body. The one or more temperature regulating channels are configured to flow a fluid through the body. Part of the inner surface of the inner bore is configured to receive meltable material for melting in the vessel. The inner surface is configured to substantially surround or enclose a tip of a plunger rod from an injection molding apparatus. Also, the at least one slot is configured to allow receipt of eddy currents into the vessel during application of an induction field to melt the meltable material in the body. The one or more temperature regulating channels are configured to regulate a temperature of the vessel during the application of the induction field via flow of the fluid therein.

Also, in accordance with embodiments, the material for melting comprises a BMG feedstock, and a BMG part may be formed.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
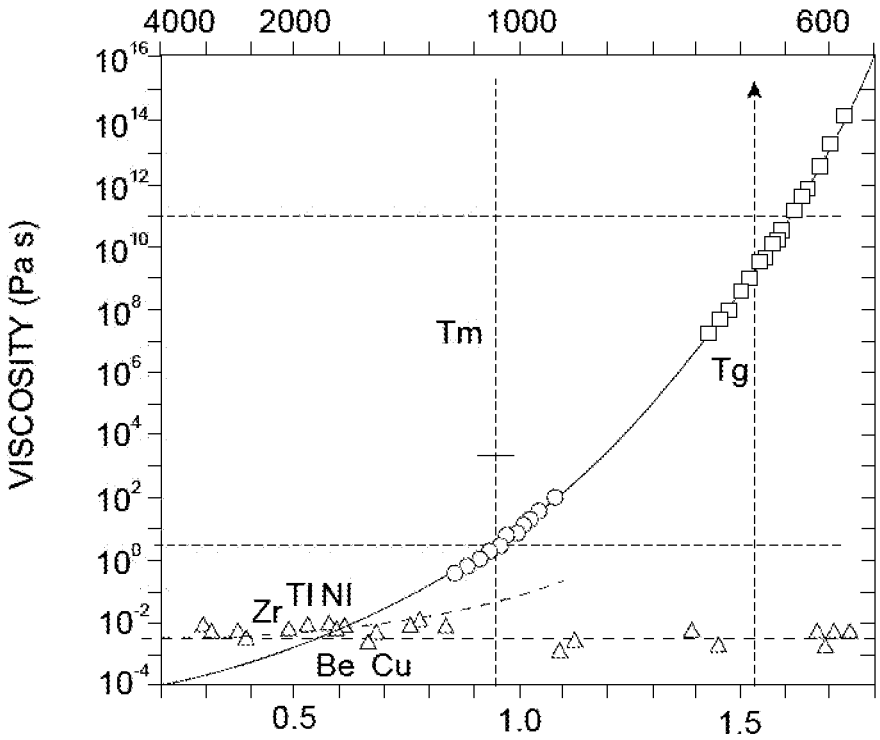
PRIOR ART FIGURE 1
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
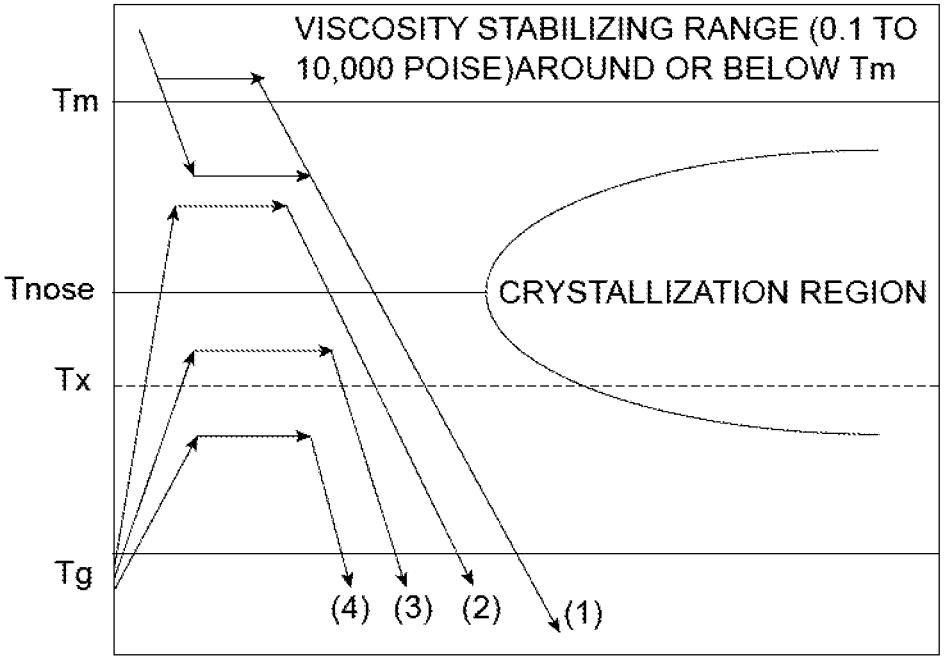
PRIOR ART FIGURE 2
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying.

Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |

TABLE 2-continued

| Additional Exemplary amorphous alloy compositions (atomic %) | | | | | | |
|---|---|---|---|---|---|---|
| Alloy | Atm % | Atm % | Atm % | Atm % | Atm % | Atm % |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0305387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo—Ln-C—B, Fe—Mn—Cr—Mo—(Y,Ln)—C—B, (Fe,Cr,Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co,Cr,Mo,Ga,Sb)—P—B—C, (Fe,Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and U.S. Pat. No. 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Co4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

According to embodiments herein, a vessel for melting materials (e.g., metals or metal alloys) is provided that is configured to receive, direct, allow receipt of, and/or utilize a magnetic field (e.g., from an induction coil) to melt materials by way of a slot. Further, embodiments herein disclose an injection molding apparatus or machine with a secondary field concentrator vessel, and a method of use of vessels as disclosed in the exemplary embodiments herein.

In accordance with various embodiments, there is provided a temperature regulated vessel. The vessel can include: a substantially tubular body with a first end and a second end along a longitudinal direction; a longitudinal slot extending between the first end and the second end of the substantially tubular body in the longitudinal direction and through a complete thickness of the substantially tubular body; and one or more temperature regulating channels configured to flow a liquid within the substantially tubular body. The vessel is configured for use with a horizontally positioned induction coil configured to melt a meltable material in the vessel. The longitudinal slot is configured to receive eddy currents within the vessel during application of an induction field by the induction coil. The substantially tubular body is configured to substantially contain a second magnetic field produced by the eddy currents from the induction field to melt the meltable material during its application. Also, the one or more temperature regulating channels are configured to regulate a temperature of the vessel during the application of the induction field.

In accordance with various embodiments, there is provided an apparatus. The apparatus can include: a vessel having an inner bore configured to receive a meltable material for melting therein; an induction coil configured to melt the meltable material in the vessel positioned adjacent thereto; and a plunger rod with a tip configured to move relative to the vessel. The vessel has a longitudinal slot extending through a complete thickness of the vessel. The longitudinal slot is configured to direct eddy currents into the inner bore during application of an induction field by the induction coil to aid in melting the meltable material during its application. The tip of the plunger rod is configured to move into the inner bore of the vessel to contain the meltable material within the vessel during the application of the induction field.

In accordance with various embodiments, there is provided a method. The method includes: providing meltable material in a vessel; operating a heat source provided adjacent to the vessel to form a molten material, and regulating a temperature of the vessel during the operating of the heat source. The vessel has a body and a slot extending through a complete thickness of the body. The body is configured to utilize a magnetic field from the heat source to the meltable material within the vessel during the operating via allowance of eddy currents into the body of the vessel through the slot. The vessel also includes one or more temperature regulating channels therein, and the regulating of the method includes flowing a fluid in the one or more temperature regulating channels.

In accordance with various embodiments, there is provided a vessel. The vessel can include: a body having an inner bore configured to receive a meltable material for melting therein and an outer surface. The inner bore can be formed by an inner surface that extends between a first end and a second end of the body. The vessel also includes at least one slot extending between the first end and the second end of the body and through the body from the outer surface to part of the surface forming the inner bore, and one or more temperature regulating channels provided within the body between the inner surface of the bore and the outer surface and extending between the first end and the second end of the body. The one or more temperature regulating channels are configured to flow a fluid through the body. Part of the inner surface of the inner bore is configured to receive meltable material for melting in the vessel. The inner surface is configured to substantially surround or enclose a tip of a plunger rod from an injection molding apparatus. Also, the at least one slot is configured to allow receipt of eddy currents into the vessel during application of an induction field to melt the meltable material in the body. The one or more temperature regulating channels are configured to regulate a temperature of the vessel during the application of the induction field via flow of the fluid therein.

Also, in accordance with embodiments, the material for melting comprises a BMG feedstock, and a BMG part may be formed.

The methods, techniques, and devices illustrated herein are not intended to be limited to the illustrated embodiments. As disclosed herein, an apparatus or a system (or a device or a machine) is configured to perform melting of and injection molding of material(s) (such as amorphous alloys). The apparatus is configured to process such materials or alloys by melting at higher melting temperatures before injecting the molten material into a mold for molding. As further described below, parts of the apparatus are positioned in-line with each other. In accordance with some embodiments, parts of the apparatus (or access thereto) are aligned on a horizontal axis. The following embodiments are for illustrative purposes only and are not meant to be limiting.

Figure 3:
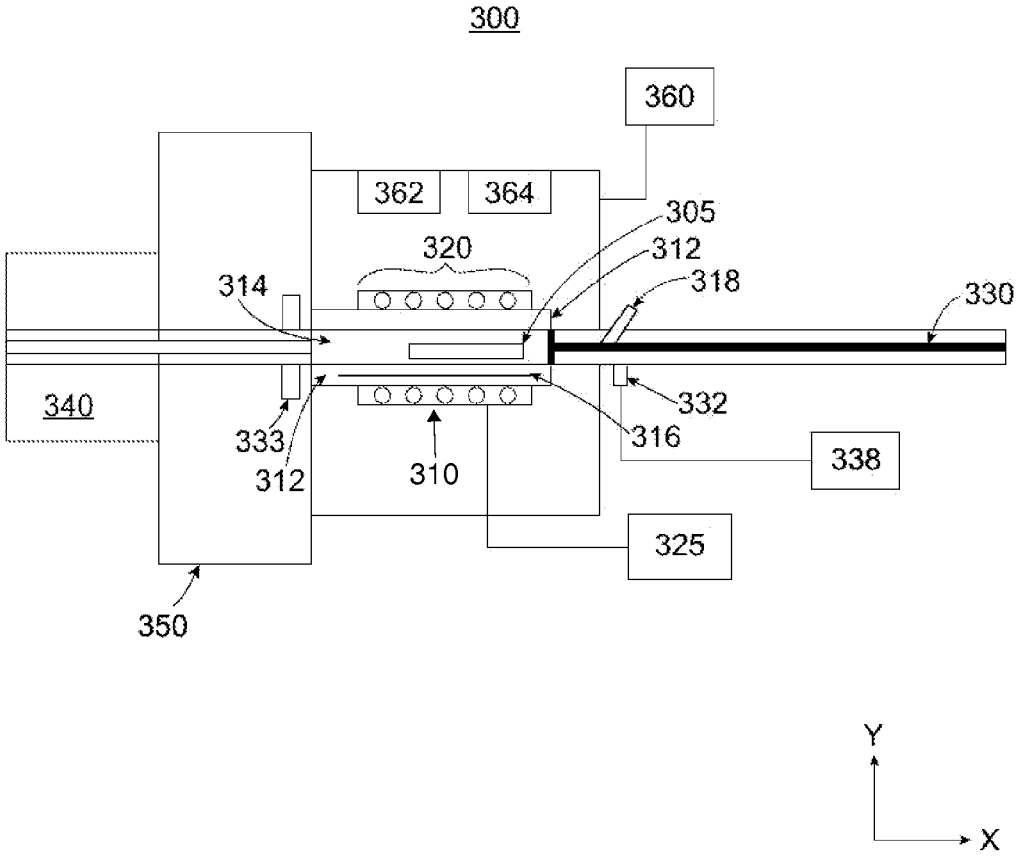
FIG. 3 shows a schematic diagram of an exemplary injection molding system/apparatus in accordance with various embodiments of the present teachings.

FIG. 3 illustrates a schematic diagram of such an exemplary apparatus. More specifically, FIG. 3 illustrates an injection molding apparatus 300. In accordance with an embodiment, injection molding system 300 can include a melt zone with an induction coil 320 configured to melt meltable material 305 received therein, and at least one plunger rod 330 configured to eject molten material 305 from the melt zone and into a mold 340. In an embodiment, at least plunger rod 330 and the melt zone are provided in-line and on a horizontal axis (e.g., X axis), such that plunger rod 330 is moved in a horizontal direction (e.g., along the X-axis) substantially through the melt zone to move the molten material 305 into mold 340. In The mold can be positioned adjacent to the melt zone.

Melt zone 310 includes a melting mechanism configured to receive meltable material and to hold the material as it is heated to a molten state. The melting mechanism may be in the form of a vessel 312, for example, that has a body for receiving meltable material and configured to melt the material therein. Vessel 312 may have an inlet for inputting material (e.g., feedstock) into a receiving or melting portion 314 of its body. The body of the vessel has a length and can extend in a longitudinal and horizontal direction, as shown in FIG. 3, such that molten material is removed horizontally therefrom using plunger 330. The material for heating or melting may be received in a melting portion 314 of the vessel 312. Melting portion 314 is configured to receive meltable material to be melted therein within the melt zone of the apparatus. For example, melting portion 314 has a surface for receiving material.

A vessel as used throughout this disclosure is a container or body made of a material employed for heating substances to high temperatures. The vessel also acts as a shot sleeve for moving molten material towards a mold. It should be understood that the terms "shot sleeve" and "vessel" may be used interchangeably throughout this disclosure with reference to a device for receiving meltable material (e.g., BMG) and containing such material during melting when a heat source or field is applied to melt the meltable material. The device can allow for movement of the molten material after a melting process into a mold. Additionally, the vessel 312 can be an induction field concentrator. That is, vessel 312 is designed and configured to locally concentrate a magnetic field (e.g., a secondary field resulting from induction source 320) to promote a reaction and thus melting of a material provided within the vessel 312.

In an embodiment, vessel 312 is a cold hearth melting device that is configured to be utilized for meltable material(s) while under a vacuum (e.g., applied by a vacuum device or pump at a vacuum port 332).

In an embodiment, vessel 312 is coated with a [more] electrically conductive material [e.g., as compared to an electrically conductive material it is made of] to improve the eddy current propogation (current density) in the vessel, which can thereby increase an intensity of the magnetic field in the melt region/adjacent the induction coil 320, and can thereby increase the temperature and possibly thermal homogeneity of the molten alloy.

In an embodiment, vessel 312 is 'tuned' to resonate electromagnetically at a particular RF frequency so that loss of RF energy is minimized, thereby improving the efficiency of the vessel and system.

In an embodiment, a body of the vessel and/or its melting portion 314 may include substantially rounded and/or smooth surfaces. For example, a surface of melting portion 314 may be formed in an arcuate, a round, or a circular shape. However, the shape and/or surfaces of the body are not meant to be limiting. The body may be an integral structure, or formed from separate parts that are joined or machined together.

The body of vessel 312 is configured to receive the plunger rod 330 therethrough in a horizontal direction to move the molten material. That is, in an embodiment, the melting mechanism is on the same axis as the plunger rod, and the body can be configured and/or sized to receive at least part of the plunger rod, e.g., the plunger tip, to substantially cover or enclose [at least the tip of] the plunger rod 330 as it moves into and through the body (in either direction). Thus, plunger rod 330 can be configured to move molten material (after heating/melting) from the vessel by moving substantially through vessel 312, and pushing or forcing molten material into a mold 340. Referencing the illustrated embodiment of apparatus 300 in FIG. 3, for example, plunger rod 330 would move in a horizontal direction from the right towards the left, through vessel 312, moving and pushing the molten material towards and into mold 340.

By substantially enclosing at least the tip of the plunger within the vessel, the plunger tip can be used to block the induction field at an end of the vessel (e.g., in front of the plunger tip). This can reduce the efficiency of melting in front of it, which can have some benefit for containment of the molten material, depending upon the arrangement of the induction coil (e.g., if using an unevenly spaced induction coil), since molten material travels from areas of strong field to those of weaker field. The molten material tends to move and suck up against the plunger tip, where the induction field can be generally less. Furthermore, since the tip of the plunger is almost entirely enclosed or captured within the vessel on almost all of its sides, plunger tip and boat wear can be significantly reduced. Moreover, capturing of the plunger tip by the vessel (using inner bore) allows or permits, at most, minimal play of the tip. This allows for a more uniform and controlled gap between the tip and the inner bore/shot sleeve. With such a controlled gap, flash cannot penetrate the gap and blow by the tip during injection. The reduction in flash by the herein disclosed vessel reduces plunger tip and vessel wear, which is the principle wear mechanism of both components, eventually causing failure.

The vessel acts to relay the magnetic field, rather than act as a shield, via one or more slot(s) provided therein. As current passes through the induction coil/source, a magnetic field is generated and emitted within the coil. This magnetic field within the coil generates currents within the vessel (eddy currents) which are able to circulate in the inner bore (inner surface) of the vessel because of one or more slots in the vessel body. The eddy currents in the inner bore generate another (second) magnetic field inside the bore, and this (second) magnetic field generates a current in any meltable material (e.g., ingot) which is inside the bore. Accordingly, the current in the meltable material heats it up, and causes it to melt via joule heating. As explained further below, the wall(s) of the herein disclosed vessel 312, such as exemplary vessels as shown in FIGS. 4-8 and FIGS. 13-14, still allow the material to melt, by utilizing and/or receiving eddy currents into the bore of the vessel via its slot(s) during application of an induction field to melt the meltable material in the body. The RF current from the induction coil is increased within the vessel during heating and melting, resulting in more efficient coupling for melting the meltable material. Additionally, with the (high) walls of the vessel, molten material cannot splash or flow over the sides of vessel during melting or during injection. The only exit for the molten metal is down the inner bore (shot sleeve), which is prevented by the coil while powered or other gating mechanism, or through the top-slot (which is unlikely). Further, the disclosed design of the vessel 312 is very strong and does not and cannot flex.

To heat melt zone 310 and melt the meltable material received in vessel 312, injection apparatus 300 also includes a heat source that is used to heat and melt the meltable material. At least melting portion 314 of the vessel, if not substantially the entire body itself, is configured to be heated such that the material received therein is melted. Heating is accomplished using, for example, an induction source 320 positioned within melt zone 310 that is configured to melt the meltable material. In an embodiment, induction source 320 is positioned adjacent vessel 312. For example, induction source 320 may be in the form of a coil positioned in a helical manner substantially around a length of the vessel body. However, other configurations or patterns that are configured to melt material within the vessel 312 can be used. As such, vessel 312 may be configured to inductively melt a meltable material (e.g., an inserted ingot 305) within melting portion 314 by supplying a magnetic field to the meltable material resulting from power being applied induction source/coil 320, using a power supply or source 325. Thus, the melt zone can include an induction zone. Induction coil 320 is configured to heat up and melt any material that is contained by vessel 312 without melting and wetting vessel 312. Induction coil 320 emits radiofrequency (RF) waves towards vessel 312 which generates a magnetic field for melting the material therein. As shown, the body and coil 320 surrounding vessel 312 may be configured for positioning in a horizontal direction along a horizontal axis (e.g., X axis). In an embodiment, the induction coil 320 is positioned in a horizontal configuration such that its turns are positioned around and adjacent the vessel 312.

Figure 11:
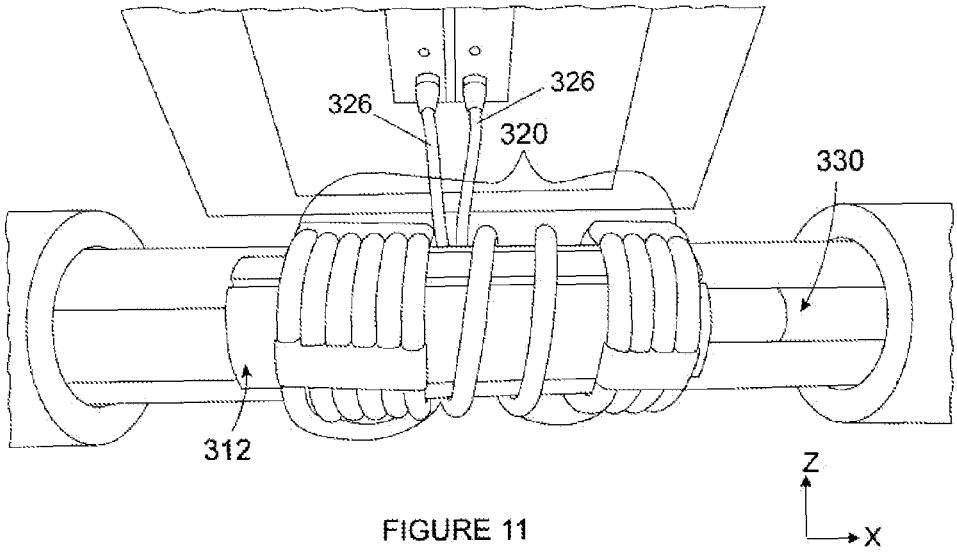
FIG. 11 illustrates a detailed, overhead view of the vessel of FIG. 4 in an injection molding apparatus with a surrounding induction coil in accordance with an embodiment of this disclosure.
Figure 12:
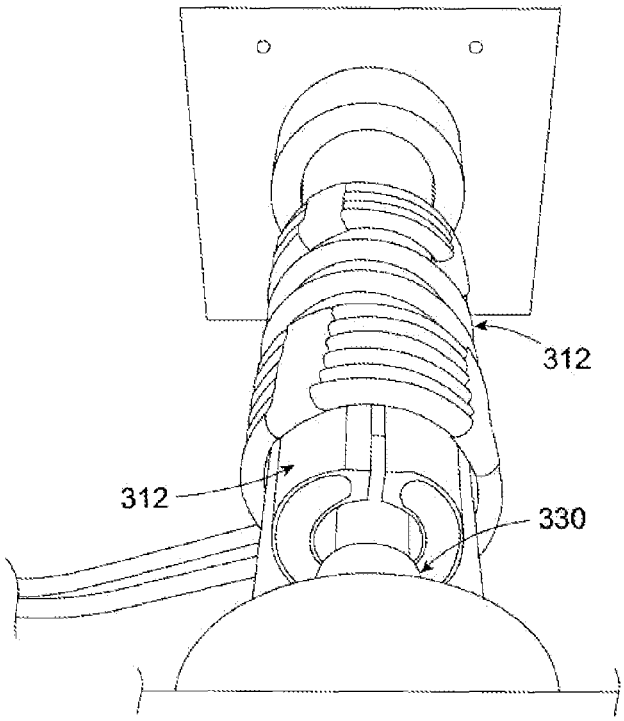
FIG. 12 illustrates an end perspective view of the vessel and surrounding induction coil of FIG. 11.
Figure 14:
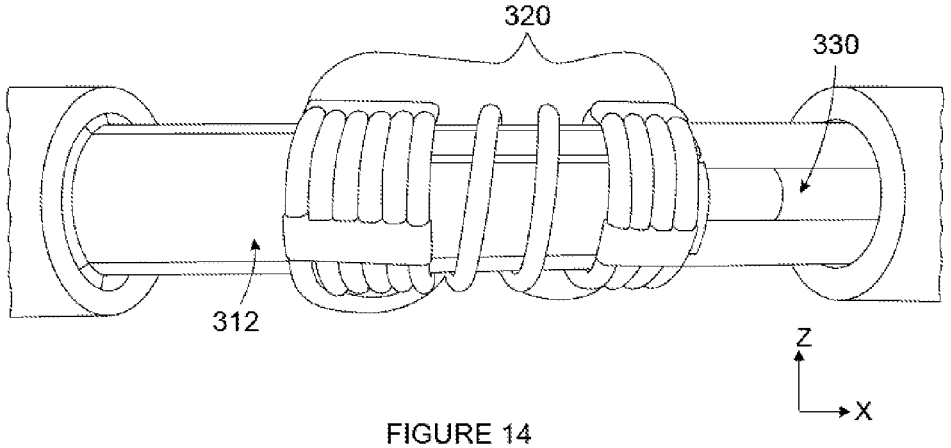
FIG. 14 illustrates a detailed, overhead view of the vessel of FIG. 13 in an injection molding apparatus with a surrounding induction coil in accordance with an embodiment of this disclosure.

In an embodiment, the induction coil 320 has unevenly spaced turns of the coil adjacent and along a length of the vessel 312. FIGS. 11-12 and 14 illustrate examples of unevenly spaced induction coils configured for use in an injection molding apparatus. The induction coil 320 can include a load induction coil and a containment induction coil that are spaced from each other. The spaced turns or parts of the coil can be part of a single coil which operates at a same frequency throughout, or can be separate coils that are configured to operate at different frequencies, for example. Such a coil can be used in cooperation with the plunger to melt material in the vessel.

In an embodiment, described further below, the vessel 312 is a temperature regulated vessel. Because there eddy currents (second magnetic field) circulating in the inner bore/inner surfaces of the vessel during application of an induction field, the body of the vessel itself is subject to melting. As such, tempering or cooling of the vessel 312 allows for its utilization before, during, and after melting of meltable material without damaging its body. Such a vessel 312 may include one or more temperature regulating channels 316 or cooling lines configured to flow a gas, a fluid, or a liquid (e.g., water, oil, or other fluid) therein for regulating a temperature of the body of vessel 312 during, for example, melting of material in the vessel (e.g., to force cool the vessel). Such a force-cooled vessel can also be provided on the same axis as the plunger rod 330. The channel(s) 316 assist in preventing excessive heating and melting of the body of the vessel 312 itself during application of the induction field (e.g., from induction coil 320). Regulating channel(s) 316 may be connected to a cooling system 360 configured to induce flow of a gas or a liquid in the vessel. The regulating channel(s) 316 may include one or more inlets and outlets for the fluid to flow there-through. An inlet and an outlet can be connected to one or more of the temperature regulating channels design to flow the fluid in, through, and out of the body. The inlets and outlets of the channels 316 may be configured in any number of ways and are not meant to be limited. For example, channel(s) 316 may be positioned relative to melting portion 314 such that material thereon is melted and the vessel temperature is regulated (i.e., heat is absorbed, and the vessel is cooled). Regulating channel(s) can be provided within the body of the vessel between an inner surface of its inner bore and its outer surface, and/or extending between a first end and a second end of its body. The number, positioning, shape, and/or direction of the regulating channel(s) should not be limited. The activation or application of cooling fluid through the channel(s) is also not limited. The cooling liquid or fluid may be configured to flow through the regulating channel(s) during melting of the meltable material, after melting of the meltable material, when induction source 320 is powered, during a period of time power is supplied to the induction source, during application of the induction field, when the induction source 320 is off, or at any interval desired or necessary to regulate the temperature of the vessel to a desired (e.g., lesser) regulated temperature. Channels may be considered input channels and output channels. The number of input channels in the vessel can, but need not be, the same as the number of output channels.

Embodiments of vessels 312 having the features described above that can be used with injection molding apparatus 300 are shown in FIGS. 4-14. That is, although not necessarily repeated in the description below, it should be understood that the description previously provided with regards to features associated with a vessel 312 can apply to each of the below-described embodiments, and vice versa.

FIGS. 4-7 illustrate an embodiment of a vessel having a substantially tubular body 400, or "body 400" as referred to herein, for meltable material to be melted therein. In an embodiment, the body 400 of the vessel 312 has a substantially tubular structure with a first end 402 (see FIG. 4) (e.g., a front or plunger insertion end) and a second end 404 (see FIG. 5) (e.g., a back or injection end) along a longitudinal direction. The body 400 has an inner surface 408 and an outer surface 410. The body 400 can be configured for positioning along a horizontal axis for use in an injection apparatus with a horizontally positioned induction coil 320.

Figure 13:
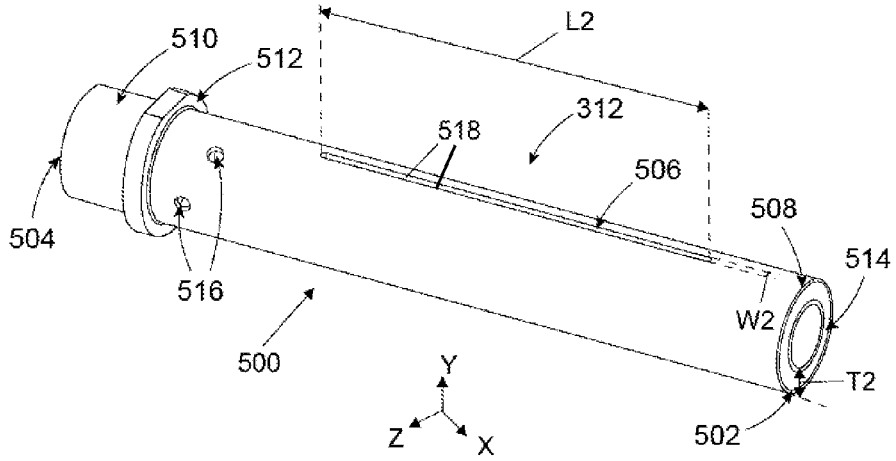
FIG. 13 illustrates a plan view of a vessel in accordance with an embodiment of this disclosure.

In general, the body 400 has a melting portion 314 therein that is configured to receive meltable material for melting by a magnetic field from an induction coil, such as induction coil 320, provided adjacent to the vessel. The body 400 can have an inner bore that acts as its melting portion and is configured to receive a meltable material for melting therein. The inner bore can be formed by an inner surface that extends between the first end 402 and the second end 404 of the body. The vessel also includes a slot extending between the first end 402 and the second end 404 and through the body from the outer surface to part of the surface forming the inner bore. The induction coil produces a magnetic field that is directed via the slot towards and into an interior of its substantially tubular structure that is approximately constant throughout the volume and is directed along the axis of the coil (e.g., inwardly and horizontally). Also, rather than just being a crucible for melting material, the vessel 312 such as shown in FIGS. 4-8 is used as a shot sleeve for injecting molten material into a mold. In accordance with an embodiment, the substantially tubular structure of the body 400 can include a wall or walls for substantially enclosing a plunger tip. FIGS. 13-14 show another body 500, described in detail later, within similar walls for enclosing the plunger tip.

Figure 5:
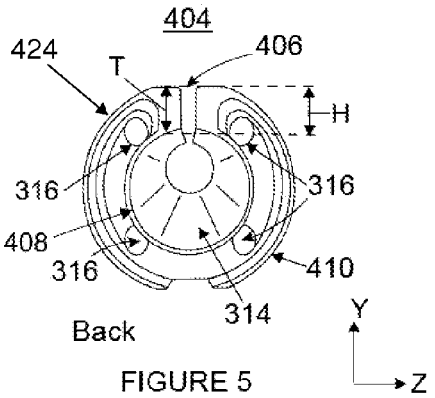
FIG. 5 illustrates an end view of a second end of the vessel of FIG. 4.
Figure 6:
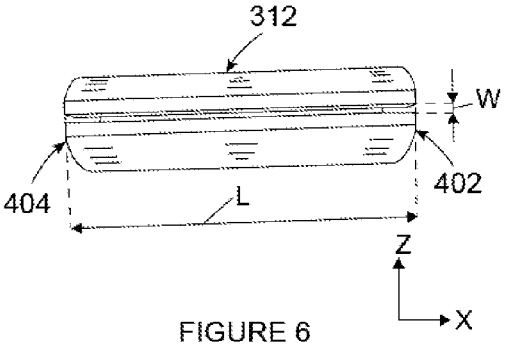
FIG. 6 illustrates a top view of the vessel of FIG. 4.
Figure 8:
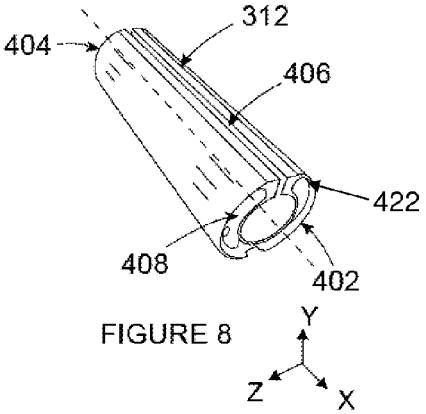
FIG. 8 illustrates a perspective view of the vessel of FIG. 4.
Figure 7:
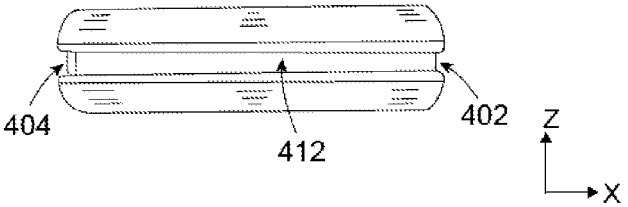
FIG. 7 illustrates a bottom view of the vessel of FIG. 4.

A top portion of the body 400 can (optionally) have substantially flat surfaces, as shown in FIGS. 6 and 8. A bottom portion 412 of the body 400 can additionally or alternatively include substantially flat surfaces, as shown in FIG. 7. The flat surfaces can be machined, for example, to allow for fixturing of a device during manufacturing or use. However, flattening or milling of the walls is exemplary only and is not necessary. The wall(s) of the body 400 can be substantially circular. The walls of the body 400 are defined by its inner surface 408 and outer surface 410. The wall can have a thickness T that essentially separates the inner surface 408 and the outer surface 410, as shown in FIG. 5. In an embodiment, the wall is substantially solid through its length and/or thickness T, with the exception of temperature regulating channel(s) running through. In an embodiment, melting portion 314 is at least part of the inner surface 408 (e.g., a bottom part and/or sides thereof). The inner surface 408 forms a receiving opening or bore through the substantially tubular body 400. In addition to receiving the meltable material for melting, the inner surface 408 is configured to receive a plunger (such as plunger 330) in and therethrough for moving molten material, as previously noted.

In an embodiment, the body 400 may have substantially rounded and/or smooth surfaces. For example, the inner surface 408 of bore of the melting portion 314 may be formed in a substantially circular, arcuate, or round shape (schematically shown in FIG. 4, for example). Outer surface 410 can be formed in a similar shape or a different shape as inner wall 408, for example, and the body 400 may or may not include flattened surfaces at its top and/or bottom. In an embodiment, the inner surface 408 of the bore can be formed in a shape and with dimensions or sizes that correspond to the plunger 330 and its tip so that the body 400 is configured to substantially enclose the plunger tip 330 as it is moved through. However, the shape and/or surfaces of the body 400 are not meant to be limiting.

The vessel shown in FIGS. 4-7 also has one or more temperature regulating lines 316 (or cooling channels) within its body 400 that are configured to allow for a flow of a liquid (e.g., water, or other fluid) therein for assisting in regulating a temperature of the vessel during application of the induction field using coil 320 and during a melting process of meltable material received in its melting portion 314. Regulating line(s) 316 can be positioned within the body 400 relative to the melting portion 314. For example, in this illustrative embodiment, the vessel has a length and extends in a longitudinal direction, and its melting portion 314 may also extend in a longitudinal direction. In accordance with an embodiment, channel(s) 316 may be positioned in a longitudinal direction relative to melting portion 314. For example, the channel(s) 316 may be positioned in a base of the body (e.g., underneath surface receiving the meltable material). In another embodiment, the channel(s) 316 may be positioned in a horizontal or lateral direction. In an embodiment, the one or more temperature regulating lines 316 are provided between the inner wall 408 (or surface of the inner bore) and the outer wall 410. The one or more temperature regulating channels can extend between ends of the body 400. The one or more temperature regulating lines 316 can extend longitudinally parallel to the horizontal axis between the first end 402 and the second end 404 of the body. As shown in FIGS. 4-8, the body 400 can include channels 316 running through a portion, area, or thickness of the wall, between the inner and outer surfaces 408 and 410.

The regulating channel(s) 316 may include one or more inlets and outlets for the liquid or fluid to flow into, therethrough, and out of the vessel. The inlets and outlets of the regulating channels may be configured in any number of ways and are not meant to be limited. Further, a direction of flow of fluid or liquid within the channel(s) is not limiting. For example, in an embodiment, the fluid may be configured to enter and exit each channel such that the liquid flows in one direction. In another embodiment, the liquid may be configured to flow in alternate directions, e.g., each adjacent line may include an alternating entrance and exit. The fluid or liquid can be configured to flow into one or more inlets, and then longitudinally along a first side of the body 400, for example, and flow longitudinally along a second side of the body 400 in an opposite direction, in each of the channels 316, and out of one or more outlets. The direction of flow within each channel need not be the same. In addition, the regulating channels may be configured to have one or more entrances/exits that are configured to allow flow of the liquid between the channels. For example, in an embodiment wherein a vessel includes longitudinally extending regulating channels, one or more of the channels may include one or more lateral or extending line(s) that extend to another channel(s) or line(s) such that they are fluidly joined to each other. That is, the liquid can be configured to not only run longitudinally along the body, but also through and between connected channel(s).

The number, shape, positioning, flow within, and/or direction of the regulating channels 316 in the vessels as shown in FIGS. 4-12 and in FIGS. 13-14 (described below) should not be limited. Also, the size (e.g., diameter or width) of the regulating channels is not limited. The size of the channels may be based on the number of regulating channels included in the body, for example, or the size of the segment or material the channels are provided in (e.g., based on a thickness of a surface, such as the thickness of the body). The size of the regulating channels may also be based on an amount of desired cooling.

As shown in FIG. 8, the body 400 includes a longitudinal slot 406, or "slot 406" as referred to herein. The slot 406 extends between the first end 402 and the second end 404 and through a complete thickness T of the substantially tubular body 400 at its top, for example. The slot 406 can extend through the body from the outer surface 410 to part of the inner surface 408 forming the inner bore. The slot 406 provides a gap or opening within the wall of the vessel. If the wall(s) of the vessel were fully closed during application of RF power from the induction source, any eddy currents that are formed can propagate in undesirable directions, e.g., not towards a meltable material. Because eddy currents produce the field which melts the meltable material/ingot within the vessel, it is desirable to obtain control over them to direct their field and currents where they are most needed during application. Thus, the herein disclosed slot 406 is configured to receive, allow, utilize, and/or direct such field (eddy) currents into the inner bore of the vessel to utilize a secondary field to melt the meltable material placed therein/thereon. If a vessel is completely enclosed (e.g., without a slot 406), the eddy currents generally travel only on or along an outer surface of the vessel, and do not enter the inner bore (e.g., melting portion 314) of the vessel to generate a magnetic field where the ingot/meltable material is. If the slot 406 itself is too thin or narrow in its width, however, eddy currents can cause arcing across the slot. Accordingly, the slot 406 can be sized to substantially reduce or prevent arcing, while still allowing the wall of the vessel to substantially enclose the plunger and melt the material therein.

In an embodiment, the vessel allows for temperature readings of the material within melting portion/its inner bore. For example, in an embodiment, the width of the slot can be sized to allow for insertion of a sensor or other detection device to read temperature readings of the meltable material. The width of the slot can also allow for observation of the meltable material within the vessel to verify that the molten material is contained (during melting), for instance.

Figure 4:
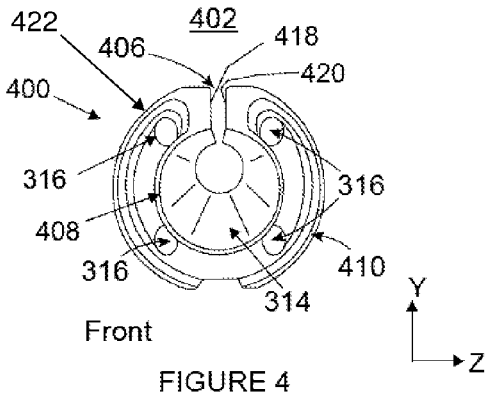
FIG. 4 illustrates an end view of a first end of a vessel in accordance with an embodiment of this disclosure.

In an embodiment, the slot 406 may be provided along a top center portion of the vessel, or topmost portion of the body 400, as shown in FIG. 4. As also shown in FIG. 4, sides of the slot 406 can be defined by parallel edges 418 and 420 or walls, each provided on parallel planes that extend laterally in a direction perpendicular to the horizontal axis.

As shown in FIG. 6, the slot 406 has a length L extending between the first end 402 and the second end 404 of the body 400 in a longitudinal direction. Ends of the slots 406 can extend fully to and/or through end surfaces at the ends 402 and 404 of the body 400, or be limited (e.g., see FIGS. 13-14). The length L of the slot 406 may depend upon the overall length of the vessel body. In an embodiment, as shown by FIG. 4, for example, the vessel has a "C"-shape. Alternatively, in an embodiment as shown in FIG. 13, for example, a slot 506 has a length L2 extending between the first end 502 and the second end 502, but ends of the slot 506 stop before or adjacent to ends 502 and 504 without extending through end surfaces thereof. The slot has a width W defined by a space between the parallel edges 418 and 420, also shown in FIG. 6. The slot 406 also has a height H, as shown in FIG. 5, which can be defined by a thickness of the wall between the inner surface 408 and the outer surface 410.

In an embodiment, the length L of the slot is between approximately 150 millimeters and approximately 225 millimeters. In an embodiment, the slot has a length of approximately 175 millimeters. In an embodiment, the slot has a length L of approximately 212 millimeters. In an embodiment, the width W of the slot is between approximately 3.0 millimeters and approximately 15 millimeters. In an embodiment, the slot has a width W of approximately 3.175 millimeters (⅛ inches). In an embodiment, the thickness T of the wall is approximately 3.0 millimeters and approximately 15 millimeters. Accordingly, the height H of the slot may be substantially similar to or equal to the thickness T of the wall. However, the above-noted ranges of dimensions of the slot are exemplary only and not intended to be limiting or critical hereto. In an embodiment, the dimensions of the slot can be configured based on the dimensions of vessel. In an embodiment, the slot is configured to be sized such that arcing (as a result of eddy currents) between the surfaces 418 and 420 is substantially prevented during application of an induction field, while still allowing for directional application into the body of the vessel to the meltable material.

In an embodiment, there is more than one slot running in parallel down a length of the vessel. For example, two or more slots can be machined or formed through the vessel wall to provide a gap or opening within the vessel. The dimensions associated with the slots need not be the same or substantially similar. In an embodiment, a first slot can have a length similar to that of the overall length of the vessel, configured to run from end to end of the vessel and therethrough, while one or more adjacent slots (e.g., on one side or on either side of the first slot) has a length that is shorter than the vessel. Of course, such an example is not limiting. The two or more slots in the vessel can be placed through the vessel body to aid in further directing eddy currents and the field towards the inner bore and melting portion of the vessel to melt material therein.

Figure 9:
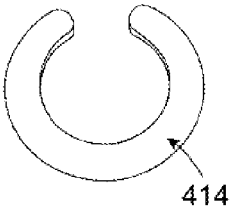
FIGS. 9 and 10 illustrate side views of end caps for use with the vessel shown in FIGS. 4-8.
Figure 10:
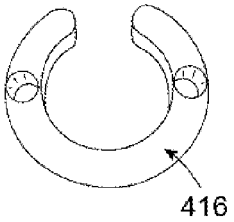

In order to provide temperature regulating channels within the body 400, in an embodiment, the channels are formed or machined therein. When running fluid through the body 400, the channels can be sealed by vacuum pressure. Referring back to the end views of the body 400 shown in FIGS. 4 and 5, in an embodiment, the ends 402 and 404 can each further include a receiving portion 422, 424, respectively, that are each configured to receive a cap for enabling vacuum sealing of ends of the regulating channels 316 during the melting process. A cap can be secured to each of the first and second ends 402 and 404 of the body 400. In an embodiment, each receiving portion 422 and/or 424 is provided in the form of a recessed pocket extending into the end surfaces at ends 402 and 404. The recessed pockets can have a "C"-shape, for example, shown in FIGS. 4 and 5. In an embodiment, as shown in FIGS. 9 and 10, caps 414 and 416 are formed of a substantially similar shape as the receiving portion(s) 422, 424 or recessed pockets for alignment and insertion therein. Caps 414 and 416 can have a substantially similar "C"-shape as the recessed pockets. Cap 414 may be inserted into receiving portion 422 and cap 416 may be inserted into receiving portion 424. As shown in FIG. 10, cap 416 may include holes therethrough to enable insertion of tubes for delivering fluid into the regulating channels 316 of the body 400 for temperature regulation.

Once the regulating channel(s) 316 are machined and formed within the wall of the body 400, the vessel can be assembled for use. To assemble the vessel for use, the caps 414 and 416 can be inserted on the ends and/or in the recessed pockets or receiving portions 422, 424, and machined (e.g., brazed or welded) at the ends 402 and 404 of the body 400. Caps 414, 416 can alternately be formed with threads to screw on corresponding threads formed in the ends of the body 400, e.g., corresponding threads in the receiving portions or pockets (or even corresponding threads formed in the ends of the regulating channel(s) 316 themselves), such that the caps are connected and attached thereto.

FIGS. 11 and 12 illustrate views of the vessel shown in FIGS. 4-8 in an injection molding apparatus with a helically surrounding induction coil 320 in accordance with an embodiment. In a non-limiting embodiment, the induction coil 320 has tubes that are unevenly spaced. Tubes 326 are directed from the cooling system 360 are attached to the vessel 312 via cap 416, for example. In use, the vessel 312 is vacuum-sealed via a surrounding tube (e.g., a quartz tube) (not shown) placed under vacuum by a vacuum source, and fluid flows through the regulating channels 316 of body 400 while meltable material is melted in inner sleeve 408. The body 400 is vacuum tight and not exposed to air. After the melting process, the molten material can be injected for molding by movement of the plunger 330 through the body 400.

FIG. 13 illustrates an embodiment of a vessel 312 having a substantially tubular body 500, or "body 500" as referred to herein, for meltable material to be melted therein. In an embodiment, the body 500 of the vessel has a substantially tubular structure with a first end 502 (e.g., a front or plunger insertion end) and a second end 504 (e.g., a back or injection end) along a longitudinal direction. The body 400 has an inner surface 508 and an outer surface 510. The body 500 can be configured for positioning along a horizontal axis for use in an injection apparatus with a horizontally positioned induction coil 320.

In general, the body 500 has a melting portion (not shown) therein that is configured to receive meltable material for melting by a magnetic field from an induction coil, such as induction coil 320, provided adjacent to the vessel. The body 500 can have an inner bore that acts as its melting portion and is configured to receive a meltable material for melting therein. The inner bore can be formed by an inner surface that extends between the first end 502 and the second end 504 of the body. The vessel also includes a slot extending between the first end 502 and the second end 504 and through the body from the outer surface to part of the surface forming the inner bore. The induction coil produces a magnetic field that is directed via its slot towards and into an interior of its substantially tubular structure that is approximately constant throughout the volume and is directed along the axis of the coil (e.g., inwardly and horizontally. Also, rather than just being a crucible for melting material, the vessel 312 such as shown in FIG. 13 is used as a shot sleeve for injecting molten material into a mold. In accordance with an embodiment, the substantially tubular structure of the body 50 can include a wall or walls for substantially enclosing a plunger tip. By substantially enclosing the plunger, the RF current from the induction coil is increased within the body 500 during heating and melting, resulting in more efficient coupling for melting the meltable material. The vessel acts to relay the magnetic field, rather than act as a shield. As such, the wall(s) of the vessel as shown in FIG. 13 still allow the material to melt, by generating a secondary magnetic field inside the boat from current driven through the induction coil. Furthermore, since the tip of the plunger is almost entirely enclosed or captured within the vessel on almost all of its sides, plunger tip and boat wear can be significantly reduced.

The surfaces and walls of the body can be any shape. The wall(s) of the body 500 can be substantially circular. The wall of the body 500 has an inner surface 508 and an outer surface 510. The wall can have a thickness T2 that essentially separates the inner surface 508 and the outer surface 510. In an embodiment, the wall is substantially solid through its length and/or thickness T2, with the exception of temperature regulating channel(s) running through. In an embodiment, the melting portion is at least part of the inner surface 508 (e.g., a bottom part and/or sides thereof). The inner surface 508 forms a receiving opening or bore through the substantially tubular body 500. In addition to receiving the meltable material for melting, the inner surface 508 is configured to receive a plunger (such as plunger 330) in and therethrough for moving molten material, as previously noted.

In an embodiment, the body 500 may have substantially rounded and/or smooth surfaces. For example, the inner surface 508 of bore may be formed in a substantially circular, arcuate, or round shape (schematically shown in FIG. 13, for example). Outer surface 510 can be formed in a similar shape or a different shape as inner wall 508, for example. In an embodiment, the inner surface 508 of the bore can be formed in a shape and with dimensions or sizes that correspond to the plunger 330 and its tip so that the body 500 is configured to substantially enclose the plunger tip 330 as it is moved through. However, the shape and/or surfaces of the body 500 are not meant to be limiting.

The vessel shown in FIG. 13 also has one or more temperature regulating lines (or cooling channels) (not shown) within its body 500 that are configured to allow for a flow of a liquid (e.g., water, or other fluid) therein for assisting in regulating a temperature of the vessel body during an induction field/melting process. Regulating line(s) can be positioned within the body 500 relative to the melting portion or inner surface 508. For example, in an embodiment, channel(s) may be positioned in a longitudinal direction relative to the body 500, such as previously described with reference to FIGS. 4-7. In other embodiments, the channel(s) 316 may be positioned in a horizontal or lateral direction. In an embodiment, the one or more temperature regulating lines are provided between the inner wall 508 (or surface of the inner bore) and the outer wall 510. The one or more temperature regulating channels can extend between ends of the body 500. The one or more temperature regulating lines can extend longitudinally parallel to the horizontal axis between the first end 502 and the second end 504 of the body 500. The body 500 can include channels running through a portion, area, or thickness of the wall, between the inner and outer surfaces 508 and 510.

The regulating channel(s) may include one or more inlets and outlets—both generally represented as 516 on body 500 in FIG. 13—for the liquid or fluid to flow into, therethrough, and out of the vessel. As shown in FIG. 13, the inlets and outlets 516 can be provided adjacent the second end 504 of the body 500. The inlets and outlet 516 can be slots or openings provided around the perimeter of the body 500. The inlets and outlets 516 are configured to communicate with a cooling system to input and output a cooling fluid or liquid. In an embodiment, the inlets and outlets 516 are offset or staggered relative to one another. For example, the inlets may be provided in a first area, and the outlets may be provided on a second area. The inlets and outlets 516 of the regulating channels may be configured in any number of ways and are not meant to be limited. Further, a direction of flow of fluid or liquid within the channel(s) is not limiting. For example, in an embodiment, the fluid may be configured to enter and exit each channel such that the liquid flows in one direction. In another embodiment, the liquid may be configured to flow in alternate directions, e.g., each adjacent line may include an alternating entrance and exit. The fluid or liquid can be configured to flow into one or more inlets or entrances, and then longitudinally along a first side of the body 500, for example, and flow longitudinally along a second side of the body 500 in an opposite direction, in each of the channels, and out of one or more outlets or exits. The direction of flow within each channel need not be the same. In addition, the regulating channels may be configured to have one or more entrances/exits that are configured to allow flow of the liquid between the channels. For example, in an embodiment wherein a vessel has longitudinally extending regulating channels, one or more of the channels may include one or more lateral or extending line(s) that extend to another channel(s) or line(s) such that they are fluidly joined to each other. That is, the liquid can be configured to not only run longitudinally along the body, but also through and between connected channel(s).

In an embodiment, the channels are provided in a spaced configuration between the walls 508 and 510. In an embodiment, the channels are equidistantly spaced relative to one another around the body 500. In an embodiment, the direction of flow of fluid or liquid in the channels alternates in every other channel. In an embodiment, inlet channels and outlet channels alternate around the body. In an embodiment, at least a bottom part of the vessel body includes channels that are relatively closer with regards to their relative spacing. Channels can be provided above a mid-portion or equator of the vessel in accordance with an embodiment.

The number, shape, positioning, flow within, and/or direction of the regulating channels in the vessel as shown in FIGS. 13-14, as well as the location of the inlets and outlets of such channels in either body 500 or body 400, should not be limited. Also, the size (e.g., diameter or width) of the regulating channels is not limited. The size of the channels may be based on the number of regulating channels included in the body, for example, or the size of the segment or material the channels are provided in (e.g., based on a thickness of a surface, such as the thickness of the body). The size of the regulating channels may also be based on an amount of desired cooling.

As shown, the body 500 includes a longitudinal slot 506, or "slot 506" as referred to herein. The slot 506 extends between the first end 502 and the second end 504 and through a complete thickness T2 of the substantially tubular body 500 at its top, for example. The slot 506 can extend through the body from the outer surface 510 to part of the inner surface 508 forming the bore. The slot 506 provides a gap or opening within the wall of the vessel. The slot 506 is configured to utilize and/or receive eddy currents within the body 500 of the vessel during application of an RF induction field, as described previously with respect to slot 406, and therefore such details are not repeated here. The eddy currents inside the vessel act like a second induction coil, generating a secondary field of current which penetrates the meltable material and melts it. Accordingly, the slot 506 can be sized to substantially reduce or prevent arcing, while still allowing the wall of the vessel to substantially enclose the plunger and melt the material therein.

The vessel allows for temperature readings of the material within melting portion/its inner bore. In an embodiment, the width of the slot can be sized to allow for insertion of a sensor or other detection device to read temperature readings of the meltable material. The width of the slot can also allow for observation of the meltable material within the vessel to verify that the molten material is contained (during melting), for instance.

The slot 506 may be provided along a top center portion of the vessel, or topmost portion, for example, as shown in FIG. 13. Sides of the slot 506 can be defined by parallel edges 518 or walls, each provided on parallel planes that extend laterally in a direction perpendicular to the horizontal axis.

As shown in FIG. 13, the slot 506 has a length L2 extending between the first end 502 and the second end 504 of the body 500 in a longitudinal direction. The length L2 of the slot 506 may depend upon the overall length of the vessel body. Ends of the slot 506 stop before or adjacent to ends 502 and 504 without extending through end surfaces thereof, in an embodiment. For example, the slot can be formed short of the ends of the vessel to provide rigidity at either end, to reduce or substantially prevent flexing of the body. Such ends also accommodate the manifold location and the location where molten material is pressured and forced (injected) into the mold by a plunger. The slot has a width W2 defined by a space between its parallel edges. The slot 506 also has a height H, not shown, which can be defined by a thickness of the wall between the inner surface 508 and the outer surface 510.

The dimensions noted above with respect to body 400 can similarly be applied to body 500. That is, in an embodiment, the length L of the slot is between approximately 150 millimeters and approximately 225 millimeters. In an embodiment, the slot has a length of approximately 175 millimeters. In an embodiment, the slot has a length L of approximately 212 millimeters. In an embodiment, the width W of the slot is between approximately 3.0 millimeters and approximately 15 millimeters. In an embodiment, the slot has a width W of approximately 3.175 millimeters (⅛ inches). In an embodiment, the thickness T of the wall is approximately 3.0 millimeters and approximately 15 millimeters. However, the above-noted ranges of dimensions of the slot are exemplary only and not intended to be limiting or critical hereto. In an embodiment, the dimensions of the slot can be configured based on the dimensions of vessel. In an embodiment, the slot is configured to be sized such that arcing (as a result of eddy currents) between the surfaces of the parallel walls or edges 518 is substantially prevented during application of an induction field, while still allowing for directional application into the body of the vessel to the meltable material.

FIG. 13 also shows that the body 500 has a flange 512 at at least one end thereof. The flange 512 is configured to secure an end of the body 500 within an injection molding apparatus and prevent movement of the body 500 relative to the injection molding apparatus. The flange 512 can prevent the body 500 from being pulled out during injection. For example, as a plunger 330 moves molten material from the body 500 and injects it into a mold, the body 500 is subject to force as the injection process takes place. As the cavity of the mold is filling via forward pressure from the plunger 330, some back pressure can be transferred to the vessel. Flange 512 aids in stabilizing and holding the vessel in the apparatus.

The flange 512 can be in the form of a protruding rim, edge, rib, or collar. It is used to strengthen the body 500, hold it in place, and/or attach it to another object in an injection molding apparatus.

The flange 512 can be provided adjacent to one of the first end 502 or the second end 504. In an embodiment, as shown in FIG. 13, the flange 512 is provided adjacent the second end. In an embodiment, the flange 512 is configured for insertion on a mold side of the apparatus (as opposed to the plunger side). The flange is configured for positioning and securement between a mold 340 and a transfer sleeve 350, for example.

As also shown in FIG. 13, in an embodiment, the inlets and outlets 516 can be positioned adjacent to the second end 504 of the body 500 and relative to the flange 512. For example, the inlets and outlets 516 can be manufactured based on a determination of a fluid manifold used to deliver fluid to at least the vessel.

In an embodiment, instead of a flange 512, body 500 of the vessel can include a groove. For example, the groove can be provided adjacent to the second end 504 or an end of the body 500 configured for attachment to the apparatus. A ring can be provided to sit in the groove. The combination of the ring and groove can be used to secure the vessel in a similar manner as the above-described flange.

When running fluid through the body 500, the channels can be sealed by vacuum pressure. In an embodiment, to secure an end opposite to that of the flange 512, i.e., in this case the first end 502, a receiving portion can be provided therein that is configured to receive a cap 514 for enabling vacuum sealing of ends of the regulating channels during the melting process. A cap can be secured to the end 502 the body 500 as previously described with reference to FIGS. 4-10. The receiving portion can be in the form of a recessed pocket extending into the end surfaces at end 502. The recessed pockets can have a round, circular, or "O"-shape. Cap 514 can be formed of a substantially similar shape as the receiving portion, as shown in FIG. 13, and aligned and inserted therein. Assembly is similar as previously described, and cap 514 can be (electron-beam) welded or otherwise machined and attached at end 502 (e.g., screwed on using threads).

FIG. 14 illustrates an overhead view of a vessel such as shown in FIG. 13 in an injection molding apparatus with a helically surrounding induction coil 320, in accordance with an embodiment. In a non-limiting embodiment, the induction coil 320 has tubes that are unevenly spaced. The vessel is secured via its flange 512 in the apparatus. As shown, the body extends into the apparatus (e.g., see left side). Tubes from the cooling system 360 can be attached within the apparatus adjacent to the secured second end 504 of the vessel. Fluid can then be directed into the inlets and outlets 516 for regulating the body. The first end 502 can be secured via cap 514. In use, the vessel 312 is vacuum-sealed via a surrounding tube (e.g., a quartz tube) (not shown) placed under vacuum by a vacuum source, and fluid flows through the regulating channels of body 500 while meltable material is melted in inner sleeve 508 to regulate the temperature of the vessel. The body 500 is vacuum tight and not exposed to air. After the melting process, the molten material can be injected for molding by movement of the plunger 330 through the body 500.

As mentioned previously, in an embodiment, there is more than one slot running in parallel down a length of the vessel. For example, two or more slots can be machined or formed through the vessel wall to provide a gap or opening within the vessel. Dimensions associated with two or more slots need not be the same or substantially similar.

Even if not explicitly noted, it should be understood that features described with reference to the body 400 in FIGS. 4-10 can be applied to body 500 of FIGS. 13-14, and vice versa, and thus should not be restricted. Moreover, the features and capabilities described with reference to vessel 312 in FIG. 3 apply to both the exemplary embodiments of bodies 400 and 500 shown in FIGS. 4-10 and 13-14.

Other embodiments of vessels with temperature regulating channel(s) therein or associated therewith having a wall for substantially enclosing a plunger tip, besides those illustrated in the Figures, are also envisioned.

Again, the body 400 or 500 of the vessel allows for the plunger tip to be aligned and stabilized as it moves through the inner surface 408 or 508, as if it is going through a fully enclosed tube while still allowing use of the magnetic field from the induction coil for melting a material, without unfavorable or undesirable shielding, which can prevent the material from reaching a temperature appropriate for casting or molding. However, the slot 406 or 506 enables receipt eddy currents within and/or into the body of the temperature-regulated vessel when an induction field (current) is applied for melting, to at least aid in melting the material.

Accordingly, the above described embodiments show a vessel capable of allowing an induction field (eddy currents) into its inner bore to melt meltable material using at least one slot, capable of substantially enclosing a plunger tip, and that can act as a shot sleeve (via its inner bore) for injecting molten material into a mold, and its method of use. In addition to the previously noted features (described with reference to vessel 312 in FIG. 3, for example) and capabilities, the herein disclosed vessel contains the alloy while it is being melted while keeping the alloy free of contamination, as well as keeping the alloy from becoming wetted to the machine. The herein disclosed vessel also acts as a mechanical channel (via its inner bore and melting portion) through which molten material can be plunged on its way into a mold and as a sliding surface for the plunger tip to move across. Thermally, the disclosed vessel provides conduction of heat between regulating liquid/coolant and the molten material. Electromagnetically, the disclosed vessel provides a conductor of electric fields (in the form of eddy currents) and magnetic fields. The disclosed vessel is also very clean, and does not introduce foreign substances to the molten alloy.

The embodiments herein can assist in reducing the amount of power absorbed by the vessel, and therefore have more power to put into the material that is being melted. More power allows the system to achieve higher melt temperatures. However, it should be noted that this does not necessarily mean that more power needs to be applied to the induction coil 320. Rather, the vessel improves the melting process by allowing a lower application of power, since a higher melt temperature can be achieved when utilizing vessels such as those depicted herein. Accordingly, the likelihood of uniformly molded and higher quality formed parts depends upon the processes performed on the material in the injection molding system and the parts used during the processes. Uniform heating of the meltable material and maintenance of temperature of molten material in such an injection molding apparatus assists in forming a uniform molded part. The configuration and design of the vessel in either of the exemplary embodiments herein can improve and provide such features.

The meltable material can be received in the melt zone in any number of forms. For example, the meltable material may be provided into the melt zone in the form of an ingot (solid state), a semi-solid state, a slurry that is preheated, powder, pellets, etc. In some embodiments, a loading port (such as the illustrated example of an ingot loading port 318 in FIG. 3) may be provided as part of injection molding apparatus 300. Loading port 318 can be a separate opening or area that is provided within the machine at any number of places. In an embodiment, loading port 318 may be a pathway through one or more parts of the machine. For example, the material (e.g., ingot) may be inserted in a horizontal direction into the vessel 312 by plunger 330, or may be inserted in a horizontal direction from the mold side of the injection apparatus 300 (e.g., through mold 340 and/or through an optional transfer sleeve 350 into vessel 312). In other embodiments, the meltable material can be provided into the melt zone in other manners and/or using other devices (e.g., through an opposite end of the injection apparatus).

The method of melting material can be performed using vessel 312 having features such as those disclosed with reference to body 400 in FIGS. 4-8 and with reference to body 500 in FIG. 13 herein, in cooperation with an injection molding apparatus such as apparatus 300 shown in FIG. 3. Accordingly, it should be understood that any reference to vessel 312 and its features as described in this disclosure can apply to either or both of the exemplary structures shown in FIG. 4-8 or 13-14 as well as other embodiment(s) relating to the vessel as disclosed herein.

To perform a method of molding the molten material, the apparatus 300 may be configured to inject material into a mold 340 in a substantially horizontal direction by moving its plunger 330 in a longitudinal and/or horizontal direction, for example. Thus, the plunger 318 may be configured to push a material for melting into the body, optionally hold material during the melting process within the vessel and the melt zone, and/or move the melted material from the melting portion 314, in a substantially horizontal direction, by traveling through the vessel 312 (e.g., from right to left, towards the mold 340). As described above, the inner wall 408 of the vessel 312 is configured to accommodate movement of the tip and body of the plunger 330 as it is moved and extended therethrough.

In accordance with an embodiment, after the material is melted in the vessel 312, plunger 330 may be used to force the molten material from the vessel 312 and into a mold 340 for molding into an object, a part or a piece. In instances wherein the meltable material is an alloy, such as an amorphous alloy, the mold 340 is configured to form a molded bulk amorphous alloy object, part, or piece. Mold 340 has an inlet for receiving molten material there-through. An output of the vessel 312 (e.g., second or back end that is used for injection) and an inlet of the mold 340 can be provided in-line and on a horizontal axis such that plunger rod 330 is moved in a horizontal direction through body of the vessel 312 to inject molten material into the mold 340 via its inlet.

As previously noted, systems such as injection molding system 300 that are used to mold materials such as metals or alloys may implement a vacuum when forcing molten material into a mold or die cavity. Injection molding system 300 can further include at least one vacuum source or pump (not shown) operatively connected thereto that is configured to apply vacuum pressure to at least vessel 312 in the melt zone and to mold 340 via vacuum ports 333, shown in FIG. 3. The vacuum pressure may be applied to at least the parts of the injection molding system 300 used to melt, move or transfer, and mold the material therein. For example, the vessel 312 and plunger rod 330 may be under vacuum pressure and/or enclosed in a vacuum chamber during melting and molding processes.

In an embodiment, mold 340 is a vacuum mold that is an enclosed structure configured to regulate vacuum pressure therein when molding materials. For example, in an embodiment, vacuum mold 340 includes a first plate (also referred to as an "A" mold or "A" plate), a second plate (also referred to as a "B" mold or "B" plate) positioned adjacently (respectively) with respect to each other. The first plate and second plate generally each have a mold cavity associated therewith for molding melted material there-between. The mold cavities may include a part cavity for forming and molding a part, such as a BMG part, therein.

In an embodiment, the cavities of the mold 340 are configured to mold molten material received there-between via an optional injection sleeve or transfer sleeve 350 from the melt zone. Generally, the first plate of mold 340 may be connected to transfer sleeve 350. Transfer sleeve 350 (sometimes referred to as a shot sleeve, a cold sleeve or an injection sleeve in the art and herein) may be provided between melt zone 310 and mold 340. Transfer sleeve 350 has an opening that is configured to receive and allow transfer of the molten material there-through and into mold 340 (using plunger 330). Its opening may be provided in a horizontal direction along the horizontal axis (e.g., X axis). The transfer sleeve need not be a cold chamber. In an embodiment, at least plunger rod 330, vessel 312 (e.g., inner wall of its receiving or melting portion), and opening of the transfer sleeve 350 are provided in-line and on a horizontal axis, such that plunger rod 330 can be moved in a horizontal direction through the body of the vessel 312 in order to move the molten material from the vessel 312 and into (and subsequently through) the opening of transfer sleeve 350, and into mold 340. Transfer sleeve 350 may also be under vacuum pressure and/or enclosed in a vacuum chamber during melting and molding processes.

Molten material is pushed in a horizontal direction through transfer sleeve 350 and into the mold cavity(ies) via the inlet (e.g., in a first plate) and between the first and second plates. During molding of the material, the at least first and second plates are configured to substantially eliminate exposure of the material (e.g., amorphous alloy) there-between, e.g., to oxygen and nitrogen. Specifically, a vacuum is applied such that atmospheric air is substantially eliminated from within the plates and their cavities. A vacuum pressure is applied to an inside of vacuum mold 340 using at least one vacuum source that is connected via vacuum lines and ports 333. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr. An ejector mechanism (not shown) is configured to eject molded (amorphous alloy) material (or the molded part) from the mold cavity between the first and second plates of mold 340. The ejection mechanism is associated with or connected to an actuation mechanism (not shown) that is configured to be actuated in order to eject the molded material or part (e.g., after first and second parts and are moved horizontally and relatively away from each other, after vacuum pressure between at least the plates is released).

Any number or types of molds may be employed in the apparatus 300. For example, any number of plates may be provided between and/or adjacent the first and second plates to form the mold. Molds known in the art as "A" series, "B" series, and/or "X" series molds, for example, may be implemented in injection molding system/apparatus 300.

A uniform heating of the material to be melted and maintenance of temperature of molten material in such an injection molding apparatus 300 assists in forming a uniform molded part. For explanatory purposes only, throughout this disclosure material to be melted is described and illustrated as being in the form of an ingot 305 that is in the form of a solid state feedstock; however, it should be noted that the material to be melted may be received in the injection molding system or apparatus 300 in a solid state, a semi-solid state, a slurry that is preheated, powder, pellets, etc., and that the form of the material is not limiting.

The materials and manufacturing processes used to form the body of the vessel are not limited. Generally, the disclosed design of the vessel is more easily manufactured. The substantially tubular design reduces machining required to produce a vessel from metal round-stock, for example. Honing or grinding the inner diameter of the inner core is made much easier by having only a small slot (e.g., rather than a large cutout extending into the walls). This makes plating easier, for instance, using chrome, where the vessel can be honed after plating.

It should be noted that the body of vessel 312 in any of the embodiments disclosed herein may be formed from any number of materials (e.g., copper, silver), include one or more coatings or layers on any of the surfaces or parts thereof, and/or configurations or designs. For example, one or more surfaces may have recesses or grooves therein. The material(s) used to form a vessel body, the material(s) to be melted, and layer(s) of material are not meant to be limiting.

The body of the vessel 312 may be formed from or include one or more materials, including a combination of materials or alloys. For example, the vessel 312 may comprise a metal or a combination of metals, such as one selected from the group of: stainless steel (SS), copper, copper beryllium, copper chrome, amcolloy, sialon ceramic, yttria, zirconia, chrome, titanium, and stabilized ceramic coating. In an embodiment, vessel 312 is formed from a copper alloy. In an embodiment, the vessel 312 is formed from, or has coated thereon, one or more materials that are RF insensitive.

In an embodiment, one or more coatings or layers on one or more surfaces or parts of the vessel 312 are thermal insulators thermal barriers, or electrical conductors. For example, a coating can be applied to an inner sleeve of the vessel 312 using a plating technique. The coating(s) or layer(s) on surfaces or parts need not be consistent; that is, the area of application of a coating or layering material is not limited to covering an entire surface or limited to a particular thickness or pattern. Any number and/or types of methods may be used for applying a coating material to the vessel 312 and should not be limiting. In an embodiment, a coating or layer material may comprise at least one of the following group: ceramic, quartz, stainless steel, titanium, chrome, copper, silver, gold, diamond-like carbon, yttria, yttria oxide, and zirconia. Deposition of these types of materials can provide surface hardness and wear resistance while at the same time remain conductive for efficient heat transfer. Application of a coating with enhanced electrical conductivity to the disclosed vessel can increase the density of the eddy currents in the boat, and thereby increase the field strength inside the boat.

Accordingly, this disclosure describes embodiments of temperature regulated vessels designed to improve melt and process temperatures for systems, as well as improve power consumption. The embodiments herein illustrate vessels that act as induction field captures that allow receipt of and can use a (secondary) magnetic field of eddy currents for melting material in a melting portion thereof while substantially enclosing sides of a plunger tip. Moreover, this disclosure provides a such vessel utilized in a horizontal direction for melting materials such as bulk amorphous alloys. Further, it provides a combined melting zone and shot sleeve for die casting or injection molding. Accordingly, operation of apparatuses and systems can be improved by reducing costs of the vessel and improving dimensional control of the components in the entire melt and injection path.

Although not described in great detail, the disclosed injection system may include additional parts including, but not limited to, one or more sensors, e.g., temperature sensor 362, flow meters, etc. (e.g., to monitor temperature, cooling water flow, etc.), and/or one or more controllers 364. The material to be molded (and/or melted) using any of the embodiments of the injection system as disclosed herein may include any number of materials and should not be limited. In one embodiment, the material to be molded is an amorphous alloy, as described above.

Applications of Embodiments

The presently described apparatus and methods can be used to form various parts or articles, which can be used, for example, for Yankee dryer rolls; automotive and diesel engine piston rings; pump components such as shafts, sleeves, seals, impellers, casing areas, plungers; Wankel engine components such as housing, end plate; and machine elements such as cylinder liners, pistons, valve stems and hydraulic rams. In embodiments, apparatus and methods can be used to form housings or other parts of an electronic device, such as, for example, a part of the housing or casing of the device or an electrical interconnector thereof. The apparatus and methods can also be used to manufacture portions of any consumer electronic device, such as cell phones, desktop computers, laptop computers, and/or portable music players. As used herein, an "electronic device" can refer to any electronic device, such as consumer electronic device. For example, it can be a telephone, such as a cell phone, and/or a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The coating can also be applied to a device such as a watch or a clock.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A temperature regulated vessel, comprising:

a substantially cylindrical body having a cylindrical axis, comprising:

a first end;

a second end; and a substantially cylindrical inner wall extending between the first end and the second end of the body, the substantially cylindrical inner wall comprising:

a continuous first portion extending along at least a bottom quarter of the substantially cylindrical inner wall for supporting, in a direction substantially perpendicular to the cylindrical axis, an amorphous alloy during melting; and a second portion comprising a pair of edges defining a slot extending between the first end and the second end of the body and through a complete thickness of the body; and one or more temperature regulating channels configured to flow a liquid within the body.

2. The vessel of claim 1, wherein:

the substantially cylindrical body further comprises an outer wall; and the one or more temperature regulating channels are between the inner wall and the outer wall.

3. The vessel of claim 2, wherein:

the pair of edges extend from the inner wall to the outer wall; and the pair of edges are parallel to one another.

4. The vessel of claim 3, wherein a width of the slot is defined by a space between the parallel edges.

5. The vessel of claim 1, further comprising a cap disposed at the first end of the substantially cylindrical body to seal an end of the one or more temperature regulating channels.

6. The vessel of claim 5, wherein the cap is brazed or welded to the substantially cylindrical body.

7. The vessel of claim 5, further comprising:

a recessed pocket in the first end of the substantially cylindrical body, wherein the cap is disposed at least partially within the recessed pocket.

8. The vessel of claim 1, wherein the substantially cylindrical body further comprises a flange to secure the substantially cylindrical body to an injection molding apparatus and to prevent movement of the substantially cylindrical body relative to the injection molding apparatus.

9. The vessel of claim 1, wherein the continuous first portion includes no slots.

10. The vessel of claim 1, wherein the substantially cylindrical body comprises a single slot.

11. The vessel of claim 1, wherein the slot extends a full length of the substantially cylindrical body.

12. The vessel of claim 1, wherein the substantially cylindrical body comprises one or more additional slots.

13. The vessel of claim 1, wherein the continuous first portion extends along at least an entire bottom half of the substantially cylindrical inner wall.

14. An apparatus comprising:

a vessel comprising:

a substantially cylindrical body having a cylindrical axis; and a substantially cylindrical inner wall extending along the cylindrical axis and comprising:

a first portion defining a continuous surface extending along at least a bottom quarter of the substantially cylindrical inner wall for supporting a material during melting; and a second portion defining a slot substantially parallel to the cylindrical axis and through a complete thickness of the body;

an induction coil encircling the vessel and configured to melt the material; and a plunger configured to move the material through the vessel after the material is melted.

15. The apparatus of claim 14, wherein the vessel further comprises one or more temperature regulating channels configured to regulate a temperature of the vessel while the material is melted.

16. The apparatus of claim 15, wherein:

the vessel further comprises an outer wall; and the one or more temperature regulating channels are between the inner wall and the outer wall.

17. The apparatus of claim 14, further comprising a mold configured to receive the material from the vessel after the material is melted.

18. The apparatus of claim 14, wherein the continuous surface extends along at least a bottom half of the substantially cylindrical inner wall.

19. The apparatus of claim 14, wherein the vessel comprises a single slot.

20. The apparatus of claim 14, wherein the second portion extends along at least a top half of the substantially cylindrical inner wall.

21. A vessel, comprising:

an outer wall;

a substantially tubular inner wall extending along a longitudinal axis and comprising:

a continuous first portion extending along at least a bottom quarter of the inner wall for supporting a material in a direction substantially perpendicular to the longitudinal axis; and a second portion comprising at least one slot substantially aligned with the longitudinal axis and through the vessel from the inner wall to the outer wall; and one or more temperature regulating channels provided within the vessel between the inner wall and the outer wall and configured to flow a fluid therethrough.

22. The vessel according to claim 21, wherein the vessel is configured for use in a horizontal direction with a horizontally positioned induction coil configured to melt the material in the vessel.

23. The vessel according to claim 21, further comprising a flange at an end of the vessel configured to secure the vessel to an injection molding apparatus and prevent movement of the vessel relative to the injection molding apparatus.

24. The vessel according to claim 21, further comprising:

a cap coupled to an end of the vessel to seal ends of the one or more temperature regulating channels; and an inlet and an outlet connected to the one or more temperature regulating channels to flow the fluid in, through, and out of the body.

25. The vessel of claim 21, wherein the vessel comprises a single slot.

26. The vessel of claim 21, wherein:

the inner wall is substantially cylindrical;

the continuous first portion extends along a bottom half of the inner wall; and the second portion extends along a top half of the inner wall.

* * * * *